US007944152B2

(12) United States Patent
Lee et al.

(10) Patent No.: US 7,944,152 B2
(45) Date of Patent: May 17, 2011

(54) TWO-STAGE BALANCER FOR MULTI-LAMP BACKLIGHT

(75) Inventors: Shih-Chang Lee, Taipei Hsien (TW); Yi-Min Huang, Taipei Hsien (TW); Chung-Shu Lee, Taipei Hsien (TW)

(73) Assignee: Chicony Power Technology Co., Ltd., Taipei (TW)

( * ) Notice: Subject to any disclaimer, the term of this patent is extended or adjusted under 35 U.S.C. 154(b) by 254 days.

(21) Appl. No.: 12/465,225

(22) Filed: May 13, 2009

(65) Prior Publication Data

US 2010/0289414 A1 Nov. 18, 2010

(51) Int. Cl.
*H05B 41/24* (2006.01)
*H05B 37/00* (2006.01)

(52) U.S. Cl. ..... 315/277; 315/291

(58) Field of Classification Search ..... 315/276, 315/277, 283, 287, 291, 299
See application file for complete search history.

(56) References Cited

U.S. PATENT DOCUMENTS

| | | | | |
|---|---|---|---|---|
| 7,242,147 | B2 | 7/2007 | Jin | |
| 7,271,549 | B2 * | 9/2007 | Wey et al. | 315/282 |
| 7,443,112 | B2 * | 10/2008 | Wey et al. | 315/291 |
| 7,667,410 | B2 * | 2/2010 | Kim et al. | 315/274 |
| 7,872,424 | B2 * | 1/2011 | Sun et al. | 315/219 |
| 2003/0141829 | A1 * | 7/2003 | Yu et al. | 315/276 |

* cited by examiner

*Primary Examiner* — Jacob Y Choi
*Assistant Examiner* — Jimmy T Vu
(74) *Attorney, Agent, or Firm* — Chun-Ming Shih; HDLS IPR Services

(57) ABSTRACT

A two-stage balancer for a multi-lamp backlight is electrically connected to a driving unit through a driving transformer. The two-stage balancer includes a plurality of first balancing transformers, second balancing transformers, and lighting units. Each of the first balancing transformers is electrically connected to the corresponding second balancing transformers to form a two-stage structure. In addition, a primary winding and a secondary winding of the second balancing transformer is electrically connected in series to one lighting unit, respectively, to form a circuit loop. Further, each of the circuit loops is electrically connected in parallel. Whereby the two-stage balancer provides much better current balance between the parallel circuit loops, and outputs a sinusoid-like driving current to increase lighting efficacy and further maintain uniform brightness of the multi-lamp backlight.

8 Claims, 4 Drawing Sheets

TWO-STAGE BALANCER FOR MULTI-LAMP BACKLIGHT

BACKGROUND OF THE INVENTION

1. Field of the Invention

The present invention relates to a two-stage balancer for a multi-lamp backlight, and more particularly to a two-stage balancer for providing much better current balance between parallel circuit loops to maintain uniform brightness of the multi-lamp backlight.

2. Description of Prior Art

In recent years, TFT-LCD has been widely used in different applications with progress of the TFT-LCD display technology, and more particularly in desktop personal computers and multi-media TVs. In order to achieve high-brightness performance for the large-size TFT-LCD applications, the amount of lamps required for a multi-lamp backlight is large. The amount of current flowed through the lamps in parallel is influenced by the impedance between the lamps. Hence, relative brightness of the lamp driven with smaller current is darker; on the contrary, relative brightness of the lamp driven with larger current is lighter to influence uniform brightness of the multi-lamp backlight. Furthermore, the unbalanced current flowed through the lamps will reduce the lifetime of the lamps and the multi-lamp backlight. Hence, it is important to balance the amount of current flowed through the lamps.

U.S. Pat. No. 7,242,147 disclosed a current sharing scheme for a multiple CCF lamp operation. The current sharing scheme includes a plurality of balancing transformers to facilitate current sharing in a multi-lamp backlight system. Reference is made to FIG. 1 which is a circuit block diagram of a prior art current sharing scheme. The current sharing scheme includes a first transformer group 706, a second transformer group 710, and a lighting apparatus group 708. The first transformer group 706 has a plurality of first balancing transformers 706_1~706_*k*, the second transformer group 710 has a plurality of second balancing transformers 710_1~710_*k*, and the lighting apparatus group 708 has a plurality of lighting apparatuses 708_1~708_*k*. The first transformer group 706 is electrically connected to the second transformer group 710 for forming a ring connection. The lighting apparatuses 708_1~708_*k* are electrically connected between the first balancing transformers 706_1~706_*k* and the second balancing transformers 710_1~710_*k*, respectively. Each of the first balancing transformers 706_1~706_*k* has a primary winding and a secondary winding, and each of the second balancing transformers 710_1~710_*k* has a primary winding and a secondary winding. The respective secondary windings of the first balancing transformers 706_1~706_*k* are in series coupled together in a closed loop. Also, the respectively secondary windings of the second balancing transformers 710_1~710_*k* are in series coupled together in a closed loop. Each of the primary windings of the first balancing transformers 706_1~706_*k* is electrically connected to a first terminal of the corresponding lighting apparatuses 708_1~708_*k*. Also, each of the primary windings of the second balancing transformers 710_1~710_*k* is electrically connected to a second terminal of the corresponding lighting apparatuses 708_1~708_*k*.

However, each of the lighting apparatuses 708_1~708_*k* is connected in series between one first balancing transformer 706_1~706_*k* and one second balancing transformer 710_1~710_*k*. Hence, distortions on the current waveform of the lighting apparatuses 708_1~708_*k* are largely caused when any one of the first balancing transformers 706_1~706_*k* or the second balancing transformers 710_1~710_*k* is unbalanced. Because each of the lighting apparatuses 708_1~708_*k* needs to match one first balancing transformers 706_1~706_*k* and one second balancing transformers 710_1~710_*k*, the use amount of magnetic components is large to make a higher cost.

Accordingly, a two-stage balancer for a multi-lamp backlight is provided to solve the above-mentioned disadvantages.

SUMMARY OF THE INVENTION

In order to achieve the objective mentioned above, the present invention provides a two-stage balancer for a multi-lamp backlight, and the two-stage balancer includes a first balancing transformer group, a second balancing transformer group, and a lighting unit group.

The first balancing transformer group includes a plurality of first balancing transformers, and each of the first balancing transformers has a primary winding and a secondary winding. The secondary windings of the first balancing transformers are coupled in series in a closed loop. The second balancing transformer group includes a plurality of second balancing transformers, and each of the second balancing transformers has a primary winding and a secondary winding. A second terminal of the primary winding of each second balancing transformer is electrically connected to a first terminal of the secondary winding of each second balancing transformer to form a common node. Also, the common node is electrically connected to a second terminal of the primary winding of the corresponding first balancing transformer. The lighting unit group includes a plurality of lighting units. A first terminal of the primary winding of each second balancing transformer is electrically connected to a first terminal of the lighting unit, and a second terminal of the secondary winding of each second balancing transformer is electrically connected to a first terminal of each lighting unit. Hence, each of the second balancing transformers is electrically connected to two lighting units.

A first terminal of the primary winding of each first balancing transformer is electrically connected to a first terminal of a secondary winding of a driving transformer. Also, a second terminal of the lighting unit is electrically connected to a second terminal of the secondary winding of the driving transformer. Whereby each of the second balancing transformers is electrically connected in series to one corresponding first balancing transformers and two corresponding lighting units to form a plurality of circuit loops, and further each of the circuit loops is electrically connected in parallel.

Accordingly, the driving unit provides a driving voltage. Afterward, the driving voltage is amplified by the driving transformer to supply a high enough trigger voltage to start up the lighting units. In addition, the two-stage balancer provides much better current balance between the parallel circuit loops, and outputs a sinusoid-like driving current to increase lighting efficacy and further maintain uniform brightness of the multi-lamp backlight.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
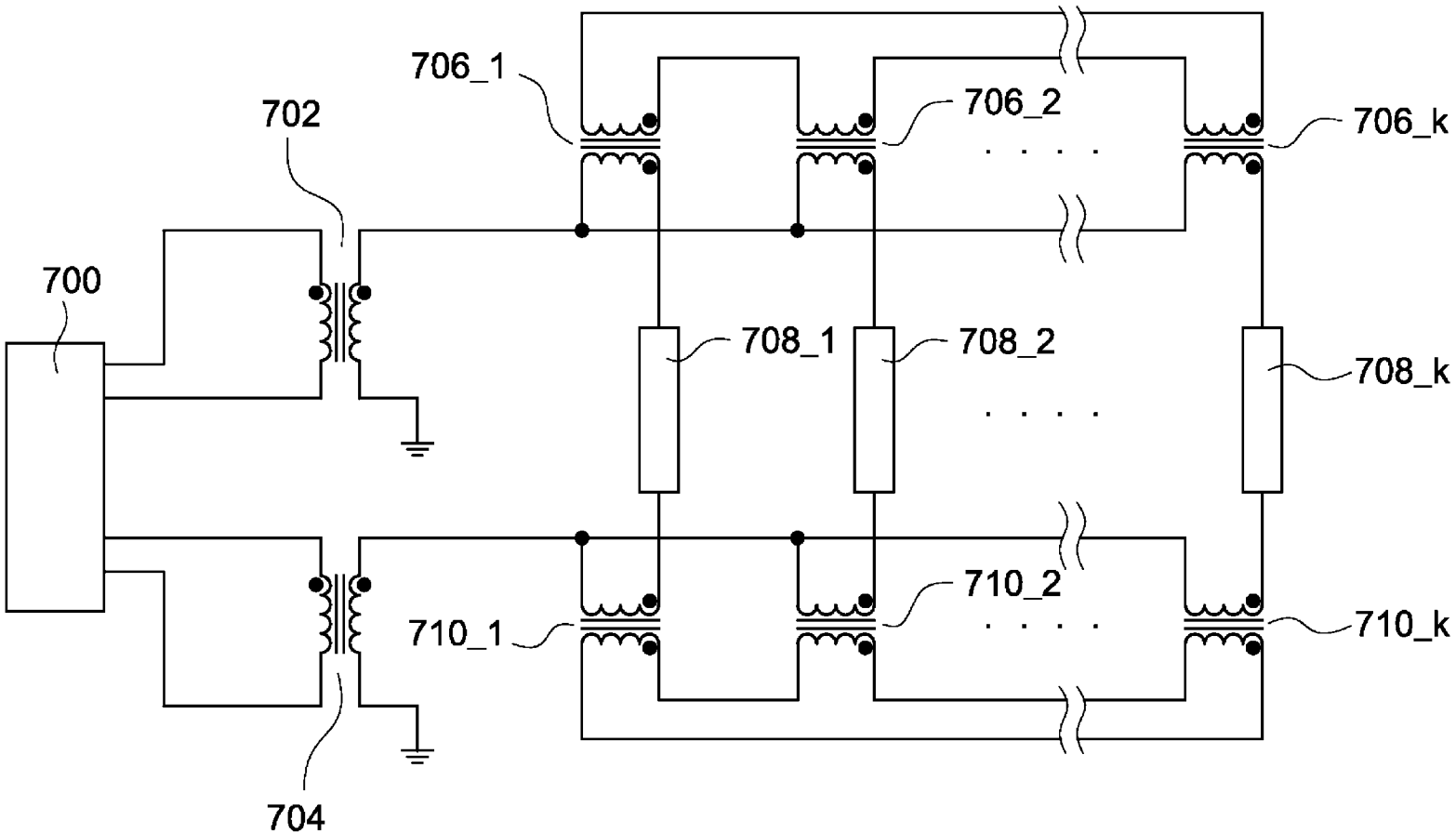
FIG.1 (Prior Art)
FIG. 1 is a circuit block diagram of a prior art current sharing scheme.
Figure 2:
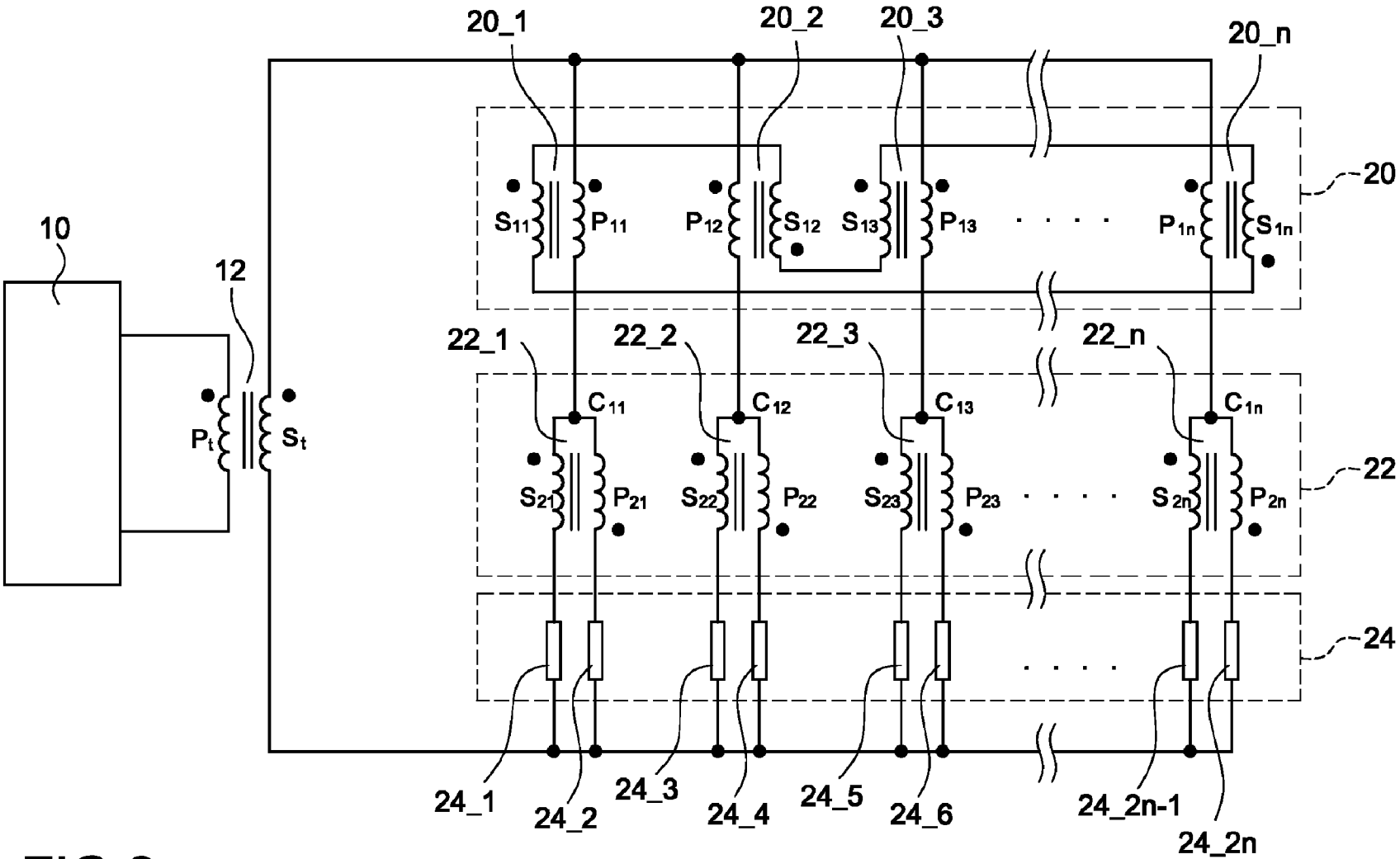
FIG. 2 is a circuit block diagram of a first embodiment of a two-stage balancer for a multi-lamp backlight according to the present invention.

Reference will now be made to the drawing figures to describe the present invention in detail. Reference is made to FIG. 2 which is a circuit block diagram of a first embodiment of a two-stage balancer for a multi-lamp backlight according to the present invention. The two-stage balancer is electrically connected to a driving unit 10 through a driving transformer 12. The driving unit 10 has a primary winding Pt and a secondary winding St. The two-stage balancer includes a first balancing transformer group 20, a second balancing transformer group 22, and a lighting unit group 24.

The first balancing transformer group 20 includes a plurality of first balancing transformers **20_1~20_*n*, and the first balancing transformers 20_1~20_*n* are identical. Each of the first balancing transformers has a primary winding $P_{11}$~$P_{1n}$ and a secondary winding $S_{11}$~$S_{1n}$. The respective secondary windings $S_{11}$~$S_{1n}$ of the first balancing transformers 20_1~20_*n* are coupled in series in a closed loop. The second balancing transformer group 22 includes a plurality of second balancing transformers 22_1~22_*n*, and the second balancing transformers 22_1~22_*n* are identical. Each of the second balancing transformers 22_1~22 is a two-winding transformer. A second terminal of the primary winding $P_{21}$~$P_{2n}$ of each second balancing transformer 22_1~22_*n* is electrically connected to a first terminal of the secondary winding $S_{21}$~$S_{2n}$ of each second balancing transformer 22_1~22_*n* to form a common node $C_{11}$~$C_{1n}$. Also, the common node $C_{11}$~$C_{1n}$ is electrically connected to a second terminal of the primary winding $P_{11}$~$P_{1n}$ of each first balancing transformer 20_1~20_*n*. The amount of the first balancing transformers 20_1~20_*n* is equal to the amount of the second balancing transformers 22_1~22_*n***.

The lighting unit group 24 includes a plurality of lighting units **24_1~24_2*n*, and the lighting units 24_1~24_2*n* are identical. The lighting unit 24_1~24_2*n* is a cold cathode fluorescent lamp (CCFL) or a light emitting diode (LED). A first terminal of the primary winding $P_{21}$~$P_{2n}$ of each second balancing transformer 22_1~22_*n* and a second terminal of the secondary winding $S_{21}$~$S_{2n}$ of each second balancing transformer 22_1~22_*n* are electrically connected to a first terminal of each lighting unit 24_1~24_2*n*, respectively. Hence, each of the second balancing transformers 22_1~22_*n* is electrically connected to two lighting units 24_1~24_2*n*. That is to say, one first balancing transformer 20_1~20_*n*, one second balancing transformer 22_1~22_*n*, and two lighting units 24_1~24_2*n* are connected in series in a circuit loop. Accordingly, the secondary winding $S_{21}$ of the second balancing transformer 22_1 and the primary winding $P_{21}$ of the second balancing transformer 22_1 are electrically connected in series to the first one lighting unit 24_1 and the second one lighting unit 24_2, respectively. Furthermore, the remaining first balancing transformers 20_1~20_*n*, the remaining second balancing transformers 22_1~22_*n*, and the remaining lighting units 24_1~24_2*n* are electrically connected in analogous ways. Finally, the second terminal of the primary winding $P_{2n}$ of the last second balancing transformer 22_*n* is electrically connected to the first terminal of the secondary winding $S_{2n}$ of the second balancing transformer 22_*n* to form the common node $C_{1n}$. The common node $C_{1n}$ is electrically connected to the second terminal of the primary winding $P_{1n}$ of the first balancing transformer 20_*n*. In addition, the first terminals of the last two lighting units 24_2*n*-1~24_2*n* are electrically connected to the second terminal of the secondary winding $S_{2n}$ of the second balancing transformer 22_*n* and the first terminal of the primary winding $S_{2n}$ of the second balancing transformer 22_*n***, respectively.

A first terminal of the primary winding $P_{11}$~$P_{1n}$ of each first balancing transformer **20_1~20_*n* is electrically connected to a first terminal of the secondary winding $S_t$ of the driving transformer 12. Also, a second terminal of each 24_1~24_2*n* is electrically connected to a second terminal of the secondary winding $S_t$ of the driving transformer 12. Hence, each of the second balancing transformers 22_1~22_*n* is electrically connected in series to one corresponding first balancing transformers 20_1~20_*n* and two corresponding lighting units 24_1~24_2*n* to form a plurality of circuit loops, and further each of the circuit loops is electrically connected in parallel. Therefore, the two-stage balancer is electrically connected to the driving transformer 12 and the driving unit 10. In this embodiment, the first terminal of the primary winding $P_{11}$~$P_{1n}$ of each first balancing transformer 20_1~20_*n* is a dot terminal, and the second terminal of the primary winding $P_{11}$~$P_{1n}$ of each first balancing transformer 20_1~20_*n* is a non-dot terminal. In addition, the first terminal of the primary winding $P_{21}$~$P_{2n}$ of each second balancing transformer 22_1~22_*n* is a dot terminal, and first terminal of the secondary winding $S_{21}$~$S_{2n}$ of each second balancing transformer 22_1~22_*n* is a dot terminal. Also, the second terminal of the primary winding $P_{21}$~$P_{2n}$ of each second balancing transformer 22_1~22_*n* is a non-dot terminal, and second terminal of the secondary winding $S_{21}$~$S_{2n}$ of each second balancing transformer 22_1~22_*n* is a non-dot terminal. Hence, a correct-polarity connection between the first balancing transformers 20_1~20_*n* and the second balancing transformers 22_1~22_*n*** to make the two-stage balancer work correctly.

The driving unit 10 is electrically connected to the primary winding $P_t$ of the driving transformer 12 to provide a driving voltage. Afterward, the driving voltage is amplified by the driving transformer to supply a high enough trigger voltage to start up the lighting units **24_1~24_2*n***. In addition, the two-stage balancer provides much better current balance between the parallel circuit loops, and outputs a sinusoid-like driving current to increase lighting efficacy and further maintain uniform brightness of the multi-lamp backlight.

Figure 3:
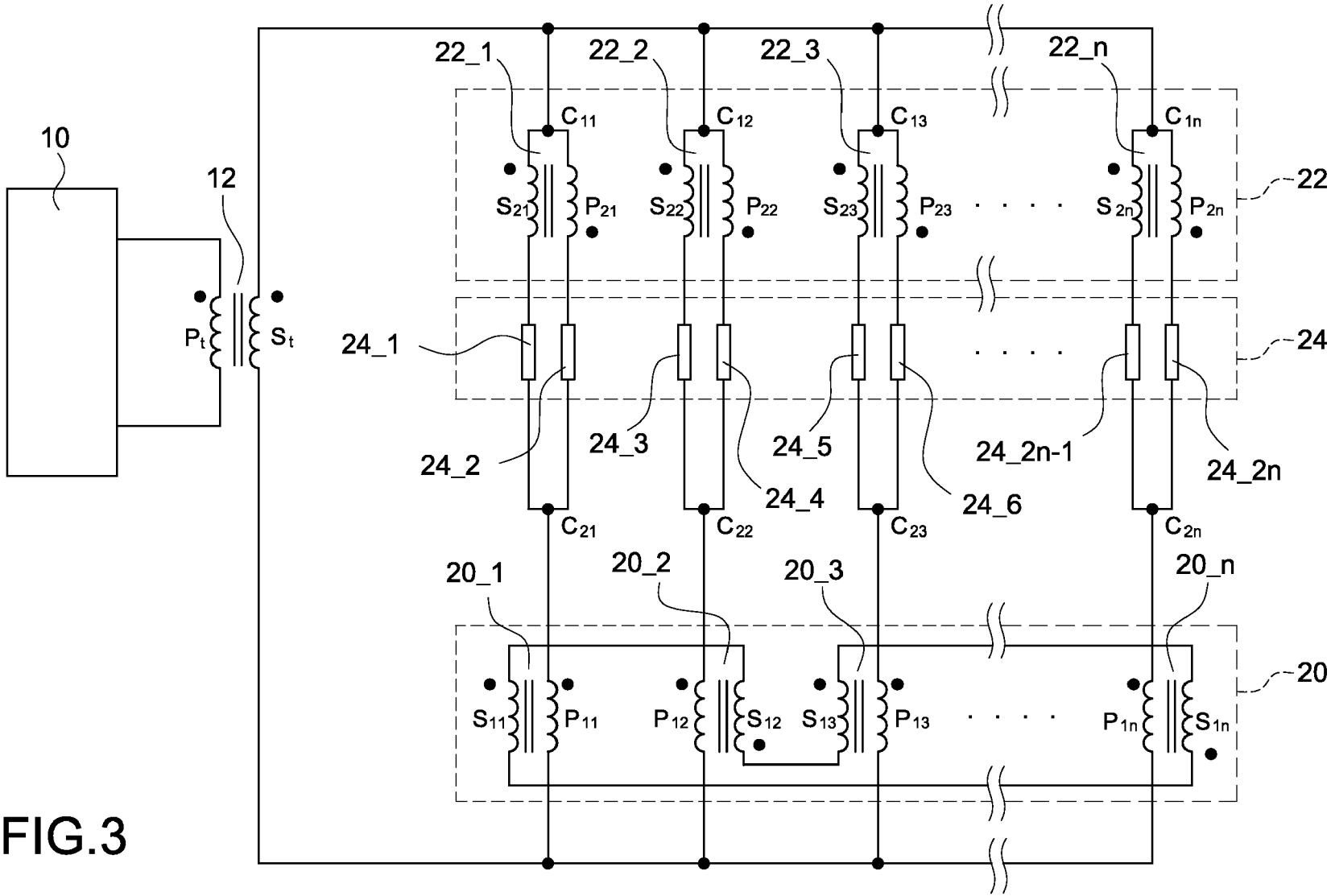
FIG. 3 is a circuit block diagram of a second embodiment of the two-stage balancer for the multi-lamp backlight.

Reference is made to FIG. 3 which is a circuit block diagram of a second embodiment of the two-stage balancer for the multi-lamp backlight. The significant difference between this and first embodiment (shown in FIG. 2) is to change the serial sequence among the first balancing transformer 20, the second balancing transformer 22, and the lighting units 24. Functionally, the connection relationship of the above-mentioned first embodiment is equivalent to the connection relationship of the second embodiment. Therefore, the use of either embodiment is based on practical layout (pin connections of the multi-lamp backlight) of the lighting unit group 24. Hence, the second terminals of each two lighting units 24_1~24_2*n* are electrically connect together to form a common node $C_{21}$~$C_{2n}$. Also, the common node $C_{21}$~$C_{2n}$ is electrically connected to the first terminal of the primary winding $P_{11}$~$P_{1n}$ of each first balancing transformer 20_1~20_*n*. In addition, the remaining first balancing transformers 20_1~20_*n*, the remaining second balancing transformers 22_1~22_*n*, and the remaining lighting units 24_1~24_2*n* are electrically connected in ways analogous to the first embodiment, therefore, the detailed description is omitted here for conciseness. Hence, each of the second balancing transformers 22_1~22_*n* is electrically connected in series to one corresponding first balancing transformers 20_1~20_*n* and two corresponding lighting units 24_1~24_2*n* to form a plurality of circuit loops, and each of the circuit loops is further electrically connected in parallel. Therefore, the two-stage balancer is electrically connected to the driving transformer 12 and the driving unit 10.

Figure 4:
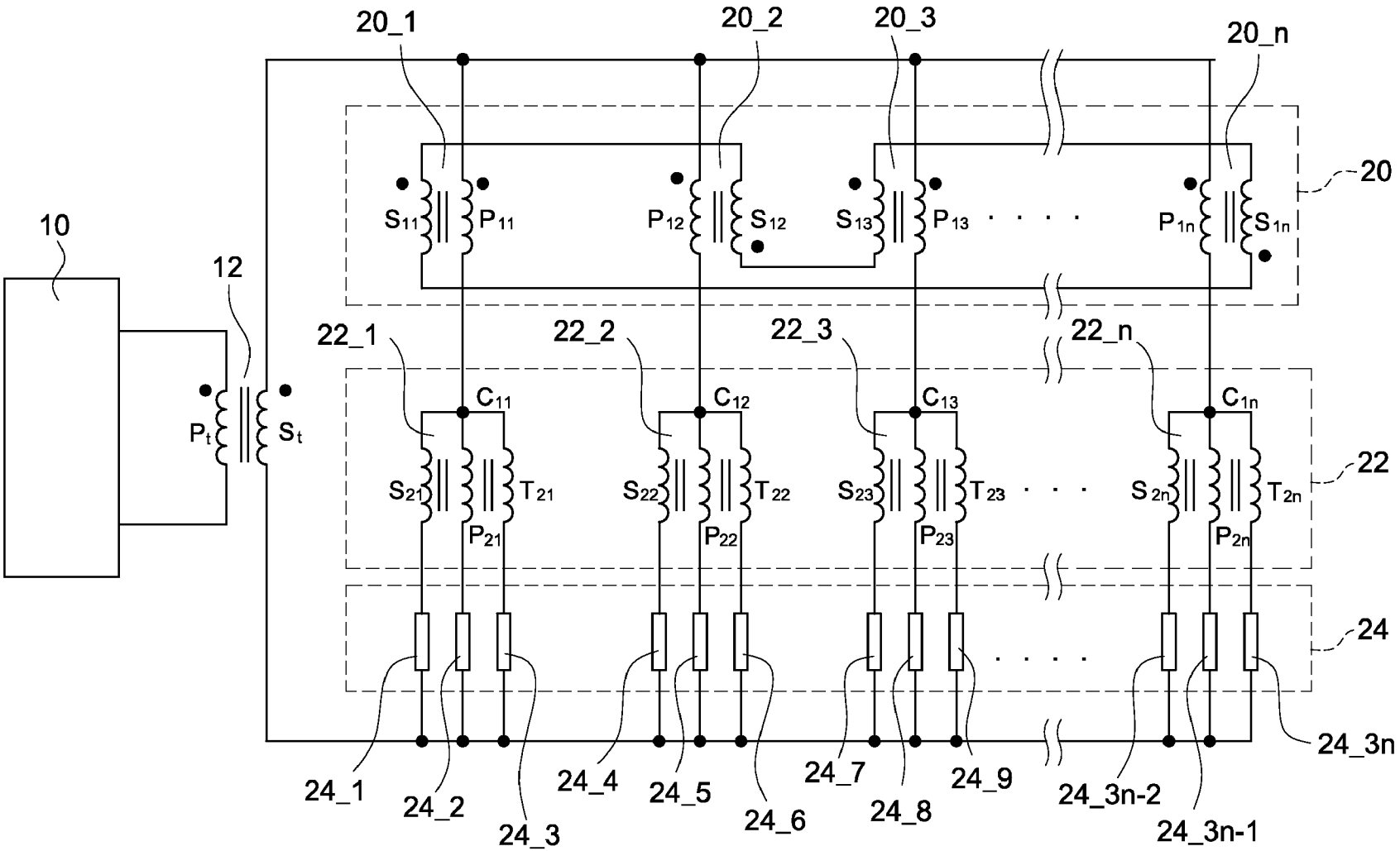
FIG. 4 is a circuit block diagram of a third embodiment of the two-stage balancer for the multi-lamp backlight.

Reference is made to FIG. 4 which is a circuit block diagram of a third embodiment of the two-stage balancer for the multi-lamp backlight. Each of the second balancing transformer 22_1~22_*n* is a multi-winding transformer. Namely, the second balancing transformer 22_1~22_*n* is an at-least-three-winding transformer, such as a three-winding or a four-winding transformer. In this embodiment, the second balancing transformer 22_1~22_*n* is a three-winding transformer. A first terminal (not labeled) of a primary winding $P_{21}$~$P_{2n}$ of each second balancing transformer 22_1~22_*n*, a first terminal (not labeled) of a secondary winding $S_{21}$~$S_{2n}$ of each second balancing transformer 22_1~22_*n*, and a first terminal (not labeled) of a tertiary winding $T_{21}$~$T_{2n}$ of each second balancing transformer 22_1~22_*n* are electrically connected to each other to form a common node $C_{11}$~$C_{1n}$. The common node $C_{11}$~$C_{1n}$ is electrically connected to a second terminal of a primary winding $P_{11}$~$P_{1n}$ of the corresponding first balancing transformer 20_1~20_*n*. In addition, a second terminal (not labeled) of a primary winding $P_{21}$~$P_{2n}$ of each second balancing transformer 22_1~22_*n*, a second terminal (not labeled) of a secondary winding $S_{21}$~$S_{2n}$ of each second balancing transformer 22_1~22_*n*, and a second terminal (not labeled) of a tertiary winding $T_{21}$~$T_{2n}$ of each second balancing transformer 22_1~22_*n* are electrically connected to a first terminal of the lighting units 24_1~24_3*n*, respectively. Hence, each of the second balancing transformers 22_1~22_*n* is electrically connected to three lighting units 24_1~24_3*n*. That is to say, the second terminal of the secondary winding $S_{21}$, the second terminal of the first winding $P_{21}$, and the second terminal of the tertiary winding $T_{21}$ of the second balancing transformer 22_1 are electrically connected to the first one lighting unit 24_1, the second one lighting unit 24_2, and the third lighting unit 24_3, respectively. Furthermore, the remaining first balancing transformers 20_1~20_*n*, the remaining second balancing transformers 22_1~22_*n*, and the remaining lighting units 24_1~24_3*n* are electrically connected in analogous ways. Finally, the second terminal of the primary winding $P_{2n}$ of the last second balancing transformer 22_*n* is electrically connected to the first terminal of the secondary winding $S_{2n}$ of the second balancing transformer 22_*n* and the third terminal of the tertiary winding $T_{21}$ of the second balancing transformer 22_*n* to form the common node $C_{1n}$. The common node $C_{1n}$ is electrically connected to the second terminal of the primary winding $P_{1n}$ of the first balancing transformer 20_*n*. In addition, the first terminals of the last three lighting units 24_$_{3}$*n*-2~24_3*n* are electrically connected to the second terminal of the secondary winding $S_{2n}$ of the second balancing transformer 22_*n*, the second terminal of the primary winding $S_{2n}$ of the second balancing transformer 22_*n*, and the second terminal of the tertiary winding $T_{21}$ of the second balancing transformer 22_*n*, respectively. In addition, the remaining first balancing transformers 20_1~20_*n* the remaining second balancing transformers 22_1~22_*n*, and the remaining lighting units 24_1~24_3*n* are electrically connected in ways analogous to the first embodiment, therefore, the detailed description is omitted here for conciseness. Hence, each of the second balancing transformers 22_1~22_*n* is electrically connected in series to one corresponding first balancing transformers 20_1~20_*n* and three corresponding lighting units 24_1~24_3*n* to form a plurality of circuit loops, and further each of the circuit loops is electrically connected in parallel. Therefore, the two-stage balancer is electrically connected to the driving transformer 12 and the driving unit 10.

In conclusion, the two-stage balancer of the present invention has the following advantages. The two-stage balancer provides much better current balance between the parallel circuit loops, and outputs a sinusoid-like driving current to reduce the current ripple, increase lighting efficacy and further maintain uniform brightness of the multi-lamp backlight.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A two-stage balancer for a multi-lamp backlight electrically connected to a driving unit through a driving transformer, and the two-stage balancer comprising:

a first balancing transformer group having a plurality of first balancing transformers; wherein each of the first balancing transformers has a primary winding and a secondary winding, and the secondary windings are coupled in series in a closed loop;

a second balancing transformer group having a plurality of second balancing transformers, and each of the second balancing transformers having a primary winding and has a secondary winding; wherein a second terminal of the primary winding of each second balancing transformer is electrically connected to a first terminal of the secondary winding of each second balancing transformer to form a common node, and the common node is electrically connected to a second terminal of the primary winding of the corresponding first balancing transformer;

a lighting unit group having a plurality of lighting units; wherein a first terminal of the primary winding of each second balancing transformer is electrically connected to a first terminal of the lighting unit, and a second terminal of the secondary winding of each second balancing transformer is electrically connected to a first terminal of each lighting unit so that each of the second balancing transformer is electrically connected to two lighting units;

wherein a first terminal of the primary winding of each first balancing transformer is electrically connected to a first terminal of a secondary winding of the driving transformer, and a second terminal of the lighting unit is electrically connected to a second terminal of the secondary winding of the driving transformer; whereby each of the second balancing transformers is electrically connected in series to one corresponding first balancing transformers and two corresponding lighting units to form a plurality of circuit loops, and each of the circuit loops is electrically connected in parallel.

2. The two-stage balancer in claim 1, wherein the lighting unit is a cold cathode fluorescent lamp.

3. The two-stage balancer in claim 1, wherein the lighting unit is a light emitting diode.

4. The two-stage balancer in claim 1, wherein the second balancing transformer is a two-winding transformer.

5. The two-stage balancer in claim 1, wherein the second balancing transformer is a multi-winding transformer with at least three windings.

6. The two-stage balancer in claim 1, wherein the first balancing transformers are identical.

7. The two-stage balancer in claim 1, wherein the second balancing transformers are identical.

8. The two-stage balancer in claim 1, wherein the lighting apparatuses are identical.

* * * * *